US007481197B1

(12) United States Patent
Li et al.

(10) Patent No.: US 7,481,197 B1
(45) Date of Patent: Jan. 27, 2009

(54) LUBRICATION DEVICE OF FOUR-STROKE ENGINES

(75) Inventors: Shao-Yu Li, Hsinchu (TW); Yeu-Jou Lin, Hsinchu (TW); Huan-Lung Gu, Hsinchu (TW); Chi-Wei Chang, Hsinchu (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 12/068,094

(22) Filed: Feb. 1, 2008

(30) Foreign Application Priority Data

Oct. 3, 2007 (TW) ..... 96137017 A

(51) Int. Cl.
*F01M 1/02* (2006.01)
*F01M 9/10* (2006.01)
*F01M 11/02* (2006.01)

(52) U.S. Cl. ..... 123/196 R; 123/196 CP

(58) Field of Classification Search ..... 123/196 R, 123/196 CP
See application file for complete search history.

(56) References Cited

U.S. PATENT DOCUMENTS 5,964,198 A * 10/1999 Wu ..... 123/196 R
6,170,456 B1 * 1/2001 Gu et al. ..... 123/196 S
6,213,078 B1 * 4/2001 Ryu et al. ..... 123/196 R
6,378,396 B1 * 4/2002 Reinhardt et al. ..... 74/595
6,622,688 B2 * 9/2003 Everts et al. ..... 123/195 R
6,644,263 B2 * 11/2003 Hare ..... 123/196 R
6,772,726 B2 * 8/2004 Kawamoto et al. ..... 123/196 W
7,363,904 B2 * 4/2008 Utsumi et al. ..... 123/196 R

* cited by examiner

*Primary Examiner*—George Nguyen
*Assistant Examiner*—David Hamaoui
(74) *Attorney, Agent, or Firm*—Birch, Stewart, Kolasch & Birch, LLP

(57) ABSTRACT

A lubricant device of four-stroke engine is provided according to the present invention. The lubricant device is applicable to a four-stroke engine having a cylinder, a crank case, a rocker arm room and a cam room connected to the rocker arm room. The lubricant device mainly has the rocker arm room and the crank case be connected to each other, and the design of alternating oil supply and oil recycling channels enables lubricant mists to cycle from the crank case through the rocker arm room to the cam room and then be re-absorbed into the crank case, thereby allowing engines to be manipulated at various angles.

23 Claims, 13 Drawing Sheets

LUBRICATION DEVICE OF FOUR-STROKE ENGINES

BACKGROUND OF THE INVENTION

1. Field of the Invention

This invention generally relates to four-stroke engine, and more specifically, to a lubrication device that is applicable to four-stroke engines.

2. Description of Related Art

In order to provide common portable work machines, such as lawn mowers, chain saws, and other trimmers with sufficient torque and long-term power, modern industry adopts designs that employ engines of internal combustion as power source. However, the foresaid portable work machines are commonly manipulated at various angles, for instance, a chain saw must be manipulated at various angles in accordance with a specific practical object to be cut, but not maintaining at a same angle; beside, to answer the manual manipulation demands of light weight and high rotation speed, two-stroke engines are preferable selections of internal combustion engine to four-stroke engines theoretically.

When a foresaid two-stroke engine is operating, it emits exhaust fume and takes in air at the same time; in this situation, the emitted exhaust fume contains some fuel unburned or incompletely burned, and it means that using the two-stroke engine will cause exhaust fume pollution; therefore, it cannot pass some of the standards and regulations of pollution emissions recently issued. On the contrary, four-stroke engines have fuel burned more completely and conform to the emission standards thus; in addition, four-stroke engines have less noise than the two-stroke engines while operating, and consequently, it is an inevitable trend of adopting four-stroke engines in the designs of power work machines.

Although four-stroke engines have advantages of less noise and lower emission pollution, they have disadvantage as well; cams and valves of the four-stroke engines require proper lubrication; therefore, a four-stroke engine must be integrated with a lubrication device; however, when a four-stroke engine integrated with a lubrication device and is applied to a work machine, such as a chain saw or others, due to the practical application environment, user is likely to manipulate the four-stroke engine at an extremely slanting or even upside down angle, and at this moment, lubricant stored inside crank case of the lubrication device is likely to flow into exhaust valves as well as flow path of air mixture in the combustion air, thereby further interfering with effective air combustion and causing engine oil leakage.

In order to overcome the existing drawbacks of four-stroke engines applied to portable work machines, some improved designs of lubrication device of four-stroke engines are provided according to claims of U.S. patents, for instance, U.S. Pat. No. 6,213,078, and U.S. Pat. No. 6,170,456, and others.

As shown in FIGS. 1A and 1B, which are diagrams of a lubrication device of four-stroke engines according to claims of U.S. Pat. No. 6,213,078; wherein, an oil hole 11 in communication with lubricant tank 12 is allocated underneath a cam room 10, and the lubricant recycles back to the lubricant tank 12 via the oil hole 11; manipulations of this kind of design at some sloping angles are likely to cause the lubricant to directly reflow to the valves via the cam room 10, and then flow out of the engine via a respiratory pipe between valve chamber and air filter.

As shown in FIG. 2, a lubrication device of four-stroke engines is disclosed according to U.S. Pat. No. 6,170,456, which mainly allocates a stirring chamber 14 on a long and narrow concave underneath the crank case 13, and also forms an oil hole 15 at a bottom of the stirring chamber 14 in communication with an engine oil tank; although this kind of design is capable of preventing massive lubricant from flowing into the crank case when the engine is at a slanting angle, it is not capable of providing other mechanical parts of machine, such as cam and gas valves and others, with effective lubrication when the engine is operationally turning over for a long time period; in addition, the traditional respiratory pipe that is externally connecting to air filter generally is not commonly allocated with filter therein, therefore, when the engine is operating at a slanting angle, lubricant is likely to flow out via the respiratory pipe, thereby causing problems of unnecessary lubricant consumption and air filter contamination.

Hence, it is a highly urgent issue in the industry for how to provide a lubrication device of four-stroke engines, which is capable of enabling lubricant to flow into valve chamber and cam room to provide effective lubrication, and meanwhile preventing massive lubricant from flowing into air-intake system and thus the cylinder, consequently causing engine extinguished, thereby allowing users to manipulate engine at various angles.

SUMMARY OF THE INVENTION

In view of the disadvantages of the prior art mentioned above, it is a primary objective of the present invention to provide a lubrication device of four-stroke engines, which enables four-stroke engines to be manipulated at various angles.

It is another objective of the present invention to provide a lubrication device of four-stroke engines, which is capable of providing proper lubrication, and consequently avoiding engine piston jammed in cylinder caused by insufficient lubrication.

It is a further objective of the present invention to provide a lubrication device of four-stroke engines, which is capable of avoiding problems of lubricant consumption as well as air filter contamination caused by massive lubricant flowing out from respiratory pipe.

To achieve the aforementioned and other objectives, a lubrication device of four-stroke engines is provided according to the present invention; the lubrication device comprises: a lubricant tank, which is connecting to underneath crank case of the engine and is for containing lubricant; a stirring chamber, which is allocated underneath the crank case and partially located inside the lubricant tank, the stirring chamber has at least one oil hole in communication with the lubricant tank; an oil stirring rod, which is allocated at one end of piston connecting rod of the engine and is received in the stirring chamber, the oil stirring rod is for stirring lubricant to oil mists; an oil supply path, the oil supply path consists of a pipeline, which connects rocker arm room and the crank case of the engine, and an oil supply channel, which is allocated inside a crankshaft first section of the crank case and correspondingly connecting the pipeline and interior of the crank case, and when the crankshaft first section rotates to a first rotation angle, the oil supply channel opens to supply the oil mists through the rocker arm room to the cam room of the engine; and an oil recycling path, the oil recycling path has an oil recycling channel, which is allocated inside the crankshaft second section and correspondingly connecting the interiors of the cam room and the crank case, and when the crankshaft second section rotates to a second rotation angle, the oil recycling channel opens to re-absorb the oil mists into the crank case.

In the foresaid lubrication device of four-stroke engines, the stirring chamber can have a long and narrow concave located inside the lubricant tank, wherein, each of the oil holes is at least located on two sides and bottom end of the long and narrow concave, but not restricted to the stated herein, each of the oil holes can further be located on bottom end of the stirring chamber nearby two sides of the long and narrow concave. In addition, basic principle of the first rotation angle and the second rotation angle is that they are alternating to each other, there is no specific restriction, and in one embodiment, the first rotation angle and the second rotation angle are alternating to each other at an angle of 180 degrees.

In one embodiment, the oil supply channel can comprises a first axial aperture, which is connected to the interior of the crank case, and a first radial aperture, which connects the first axial aperture and the pipeline. The said oil supply channel can further comprises a first eccentric aperture, which connects the first axial aperture and the interior of the crank case, and a first airtight oil plug is allocated at axle center of the crankshaft first section corresponding to a rim of the first eccentric aperture. A first obstruction block can be allocated on external side of the crankshaft first section corresponding to the first radial aperture, the first obstruction block can be, for instance, in the form of a half circular ring and is for covering area beyond the first rotation angle.

Naturally, the oil recycling channel can be accordingly designed and comprises a second axial aperture and a second radial aperture that connects the second axial aperture and the cam room. The said oil recycling channel can further comprises a second eccentric aperture that connects the second axial aperture and the interior of the crank case, and a second airtight oil plug is allocated at axle center of the crankshaft second section corresponding to a rim of the second eccentric aperture. A second obstruction block can be allocated on the crankshaft second section corresponding to the second radial aperture, and the second obstruction block can be, for instance, in the form of a half circular ring and is for covering area beyond the second rotation angle.

In another embodiment, the oil supply channel can comprise a first slanting aperture that has a first end and a second end, the first end is connecting to the pipeline while the second end is connecting to the interior of the crank case. The said oil supply channel can further comprises a first eccentric aperture that connects the second end and the interior of the crank case, and a first airtight oil plug is allocated at axle center of the crankshaft first section corresponding to a rim of the first eccentric aperture. And a first obstruction block can be allocated on external side of the crankshaft first section corresponding to the first end, the first obstruction block can be, for instance, in the form of a half circular ring and is for covering area beyond the first rotation angle.

Similarly, the oil recycling channel can also be accordingly designed and comprises a second slanting aperture that has a first end and a second end, the first end is connecting to the cam room while the second end is connecting to the interior of the crank case. The said oil recycling channel further comprises a second eccentric aperture that connects the second end and the interior of the crank case, and a second airtight oil plug is allocated at axle center of the crankshaft second section corresponding to a rim of the second eccentric aperture. And a second obstruction block is allocated on external side of the crankshaft second section corresponding to the first end, the second obstruction structure is, for instance, in the form of a half circular ring and is for covering area beyond the second rotation angle.

To reach the foresaid objectives, the present invention further provides a lubrication device of four-stroke engines, which is applicable to four-stroke engines that have cylinder, a crank case, a rocker arm room and a cam room that are connecting to each other, and a respiratory pipe; the crank case has a crankshaft that is divided into a crankshaft first section, a connection part, and a crankshaft second section; the cylinder has a piston connecting rod therein, and the piston connecting rod is connecting to the connection part; the cam room is allocated with cam that has camshaft; and the lubrication device comprises: a lubricant tank, which is connecting to underneath the crank case and is for containing lubricant; a stirring chamber, which is allocated underneath the crank case and partially-located inside the lubricant tank, the stirring chamber has at least one oil hole in communication with the lubricant tank; an oil stirring rod, which is allocated at one end of the piston connecting rod and is set inside the stirring chamber, the oil stirring rod is for stirring lubricant to oil mists; an oil supply path, the oil supply path consists of a pipeline, which connects the rocker arm room and the crank case, and an oil supply channel, which is allocated inside the crankshaft first section correspondingly connecting the pipeline and the interior of the crank case, and when the crankshaft first section rotates to a first rotation angle, the oil supply channel opens to supply the oil mists through the rocker arm room to the cam room; an oil recycling path, the oil recycling path consists of an oil recycling channel, which is allocated on the crankshaft second section correspondingly connecting the interiors of the cam room and the crank case, and when the crankshaft second section rotates to a second rotation angle, the oil recycling channel opens to re-absorb oil mists into the crank case; and an exhaust channel, the exhaust channel consists of a third axial aperture, which is allocated on the camshaft and connecting to the respiratory pipe, and a third radial aperture, which connects the third axial aperture and the cam room.

In view of the above, the lubrication device of four-stroke engine of the present invention mainly has the rocker arm room and the crank case connect to each other, and the alternating design of the oil supply and oil-absorption channels enables lubricant mists to cycle from the crank case through the rocker arm room to cam room and then to be re-absorbed into the crank case, thereby allowing engine to be manipulated at various angles; also the design of the oil supply path and the oil recycling path provides proper lubrication, and in accordance with the design of eccentric apertures and airtight oil plugs, situation of excess lubricant flowing out of the crank case can be avoided, thereby avoiding consequent problems of excessive lubricant consumption and engine piston jammed in cylinder caused by insufficient lubrication; in addition, the design of the exhaust channel employs centrifugal force to prevent oil drops or massive oil mists from entering, thereby avoiding problems of lubricant consumption and air filter contamination caused by massive lubricant flowing out through the respiratory pipe.

BRIEF DESCRIPTION OF DRAWINGS

The present invention can be more fully understood by reading the following detailed description of the preferred embodiments, with reference made to the accompanying drawings, wherein:

FIGS. 4A and 4B, which respectively illustrate a top view and a local lateral view of a crankshaft first section of four-stroke engines that the present invention is applied to;

FIGS. 5A and 5B respectively illustrate a top view of a crankshaft second section and a partial lateral view of a four-stroke engine that the present invention is applied to;

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1A:
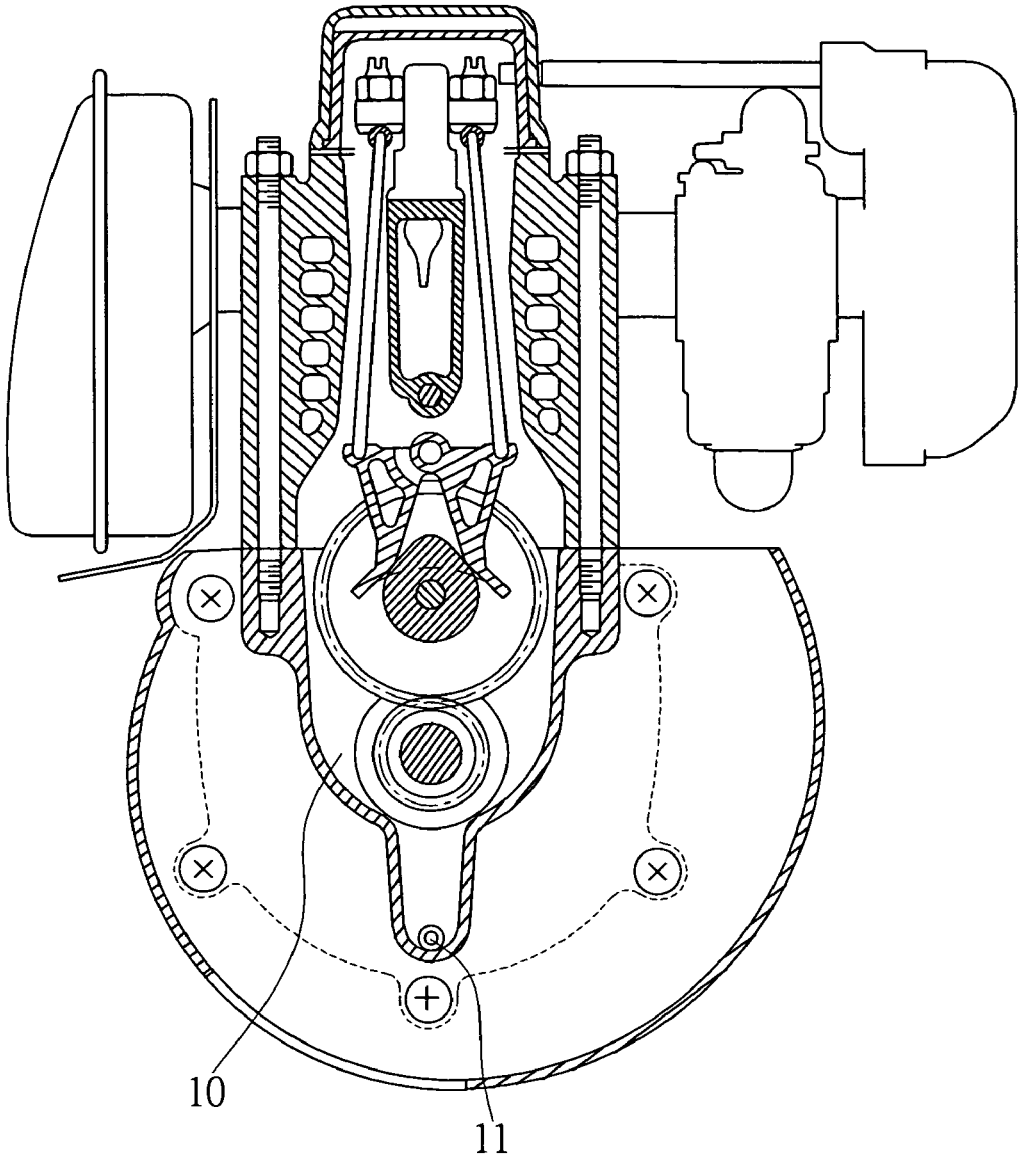
FIG. 1A (PRIOR ART)
FIGS. 1A and 1B are a top view and a lateral view of a lubrication device of four-stroke engines according to claims of U.S. Pat. No. 6,213,078, respectively.
Figure 1B:
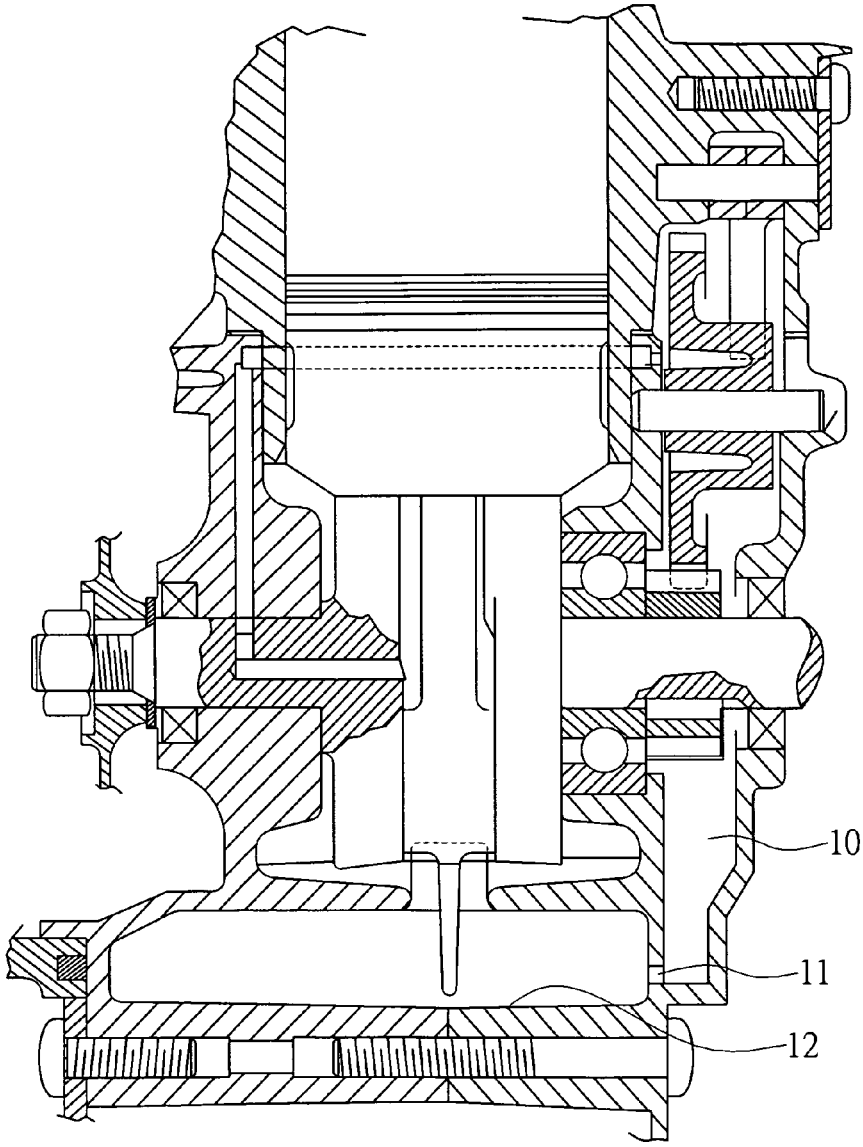
FIG. 1B (PRIOR ART)
Figure 2:
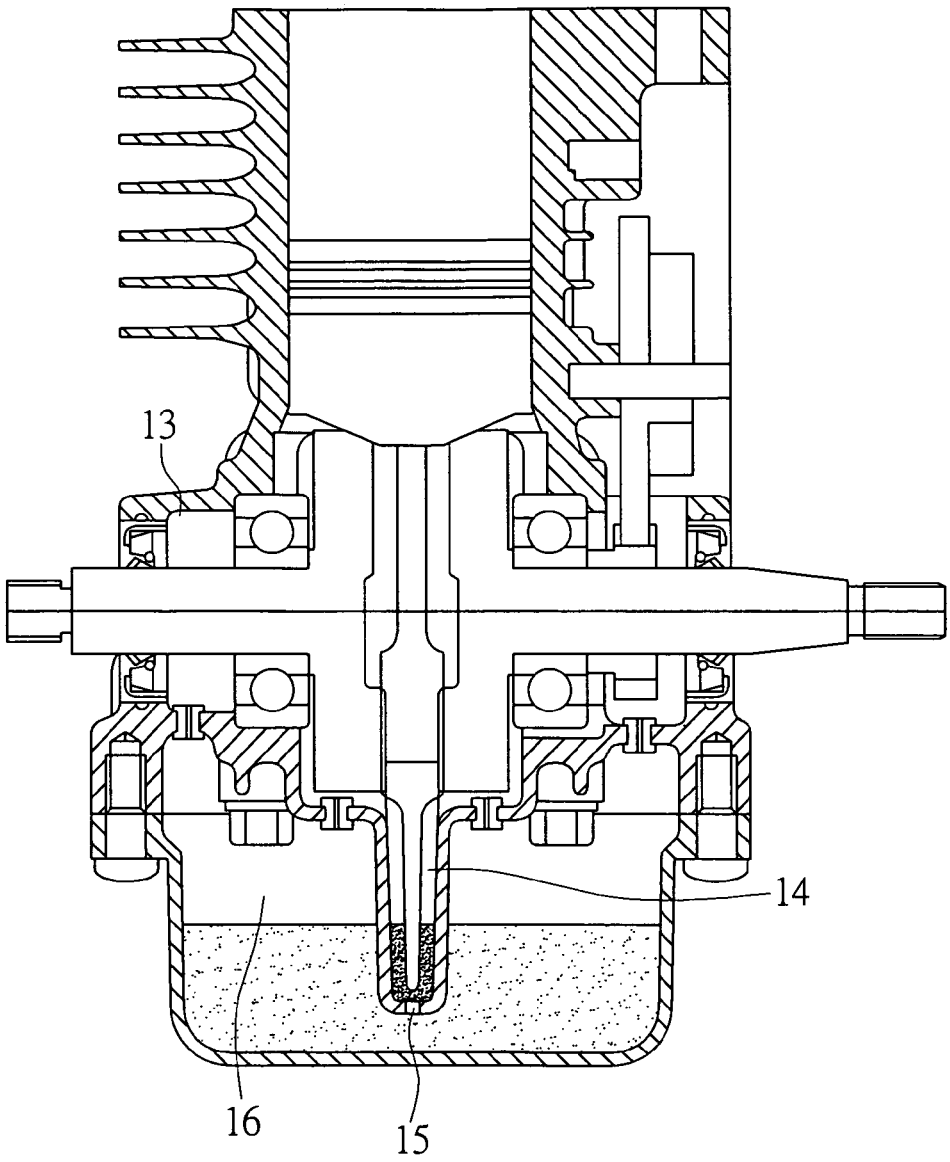
FIG. 2 (PRIOR ART)
FIG. 2 is a top view of a lubrication device of four-stroke engines according to claims of U.S. Pat. No. 6,170,456.
Figure 3A:
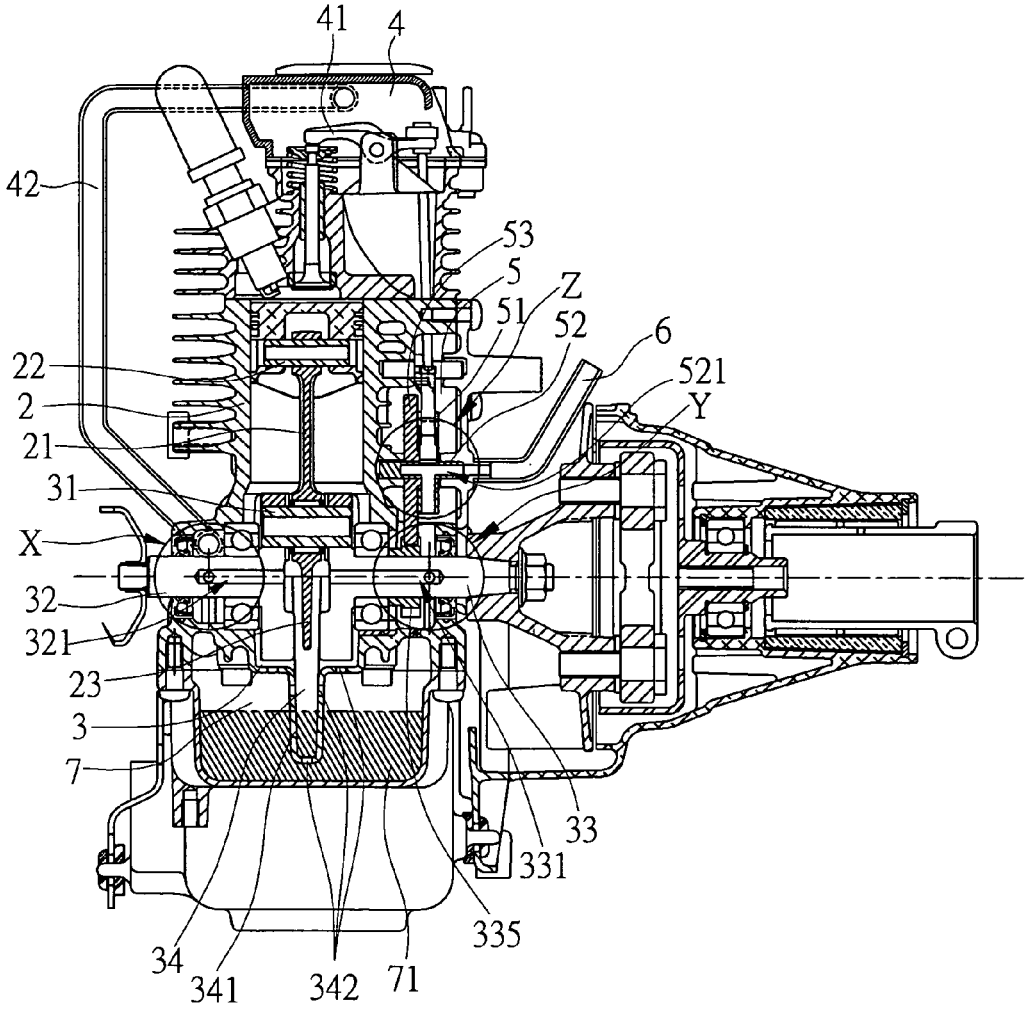
FIGS. 3A and 3B are a top view and a lateral view of a lubrication device of four-stroke engines of the present invention, respectively.
Figure 3B:
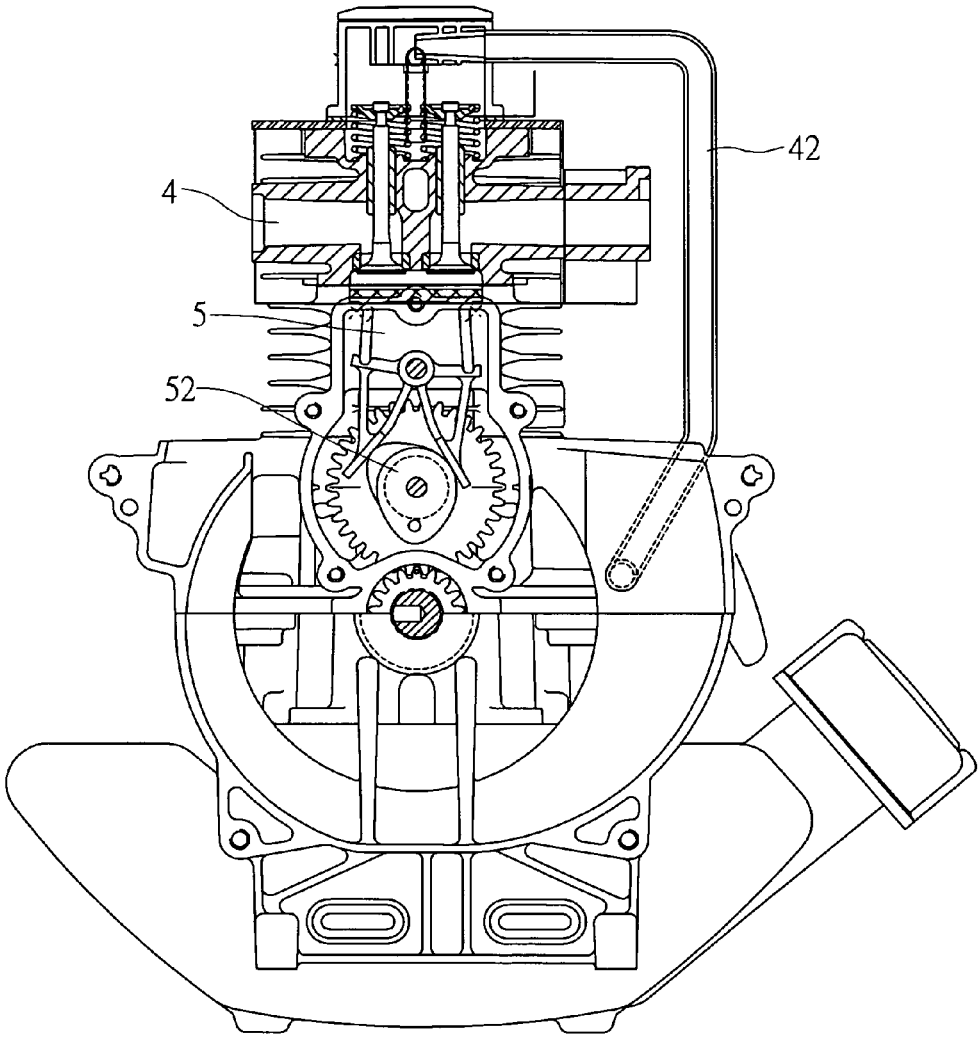

As shown in FIGS. 3A and 3B, the lubrication device of four-stroke engines of the present invention is applicable to four-stroke engines that at least have a cylinder 2, a crank case 3, a rocker arm room 4 and a cam room 5 that are connecting to each other, and a respiratory pipe 6, thereby enabling lubricant mist to be cycling from the crank case 3 through the rocker arm room 4 to the cam room 5 and then be absorbed back to the crank case 3, and allowing users to manipulate the engines at various angles.

In the present embodiment, the lubrication device is applied to, for instance, four-stroke engines of wet-sump design, wherein, the crank case and lubricant tank are connecting to each other, but not restrictive of the scope of the present invention, the lubrication device of the present invention is applicable to any four-stroke engine that must integrate with lubrication device.

In the four-stroke engines of the present embodiment, the crank case 3 has a crankshaft, the crankshaft is divided into a crankshaft first section 32 and a crankshaft second section 33 that are connected to each other via a connection part 31 and move simultaneously; the cylinder 2 consists of a piston connecting rod 21, which is connecting to the connection part 31, and a piston 22, which is connecting to top end of the piston connecting rod 21; the rocker arm room 4 has a rocker arm 41, and the cam room 5 is allocated with a cam 51 that has a camshaft 52, also the rocker arm 41 is for simultaneously activating the cam 51, in addition, the cam room 5 has a respiratory pipe 6 that is for externally connecting to a air filter (not shown in the FIG.). Since the principle of internal combustion of four-stroke engines is well understood by those in the industry, and is not a creative feature of the present invention, therefore, descriptions of engine movement principles and detailed mechanism design will not be repeated herein.

The lubrication device of the present invention comprises: a lubricant tank 7, which is integrated to underneath the crank case 3 for containing lubricant 71; a stirring chamber 34, which is allocated beneath the crankshaft 3 and partially located inside the lubricant tank 7, the stirring chamber 34 has at least one oil hole 342 in communication with the lubricant tank 7; an oil stirring rod 23, which is allocated at bottom end of the piston connecting rod 21 and is set inside the stirring chamber 34, the oil stirring rod 23 is for stirring the lubricant 71 to oil mists; an oil supply path, the oil supply path consists of a pipeline 42, which connects the rocker arm room 4 and the crank case 3, and an oil supply channel 321, which is allocated inside the crankshaft first section 32 of the crank case 3 and correspondingly connecting the pipeline 42 and interior of the crank case 3, and when the crankshaft first section 32 is at a first rotation angle, the oil supply channel 321 opens to supply the oil mists through the rocker arm room 4 to the cam room 5; and an oil recycling path, the oil recycling path consists of an oil recycling channel 331, which is allocated inside the crankshaft second section 33 and correspondingly connecting the interiors of the cam room 5 and the crank case 3, and when the crankshaft second section 33 is at a second rotation angle, the oil recycling channel 331 opens to re-absorb the oil mists to the interior of the crank case 3.

In the present embodiment, the stirring chamber 34 consists of a long and narrow concave 341 located inside the lubricant tank 7, wherein, in addition to two sides and bottom end of the long and narrow concave 341, each of the oil holes 342 can also be formed on bottom of the stirring chamber 34 nearby the two sides of the long and narrow concave 341, thereby providing engines with proper oil dropping channel at various angles even in a upside down situation, as well as balancing pressure between the crank case 3 and the lubricant tank 7; the crankshaft first section 32 and the crankshaft second section 33 are connected to each other via the connection part 31 and consequently move simultaneously, the basic principle of the said first rotation angle and the said second rotation angle is that they are alternating to each other, but there is no specific restriction; in the present embodiment, the first rotation angle and the second rotation angle are alternating to each other at an angle of 180 degrees as an example, but not restricted to the stated herein.

Figure 4A:
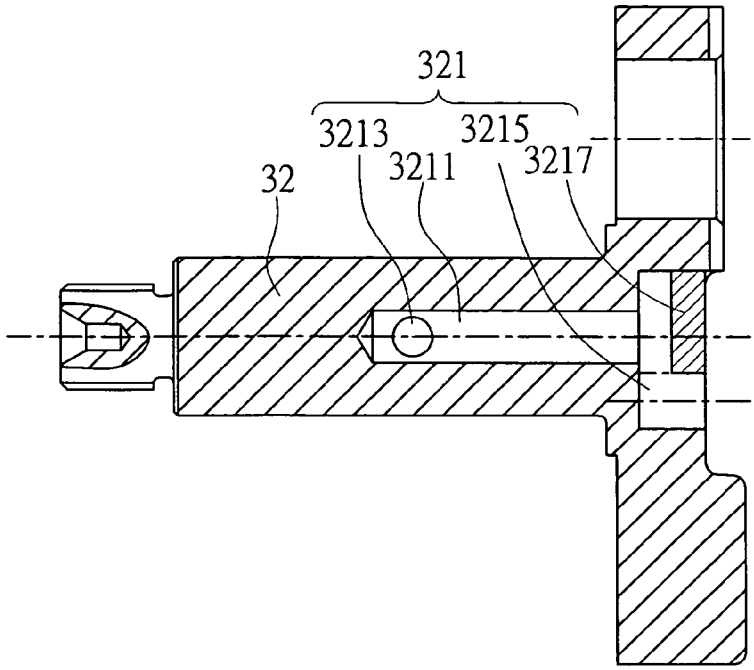
Figure 4B:
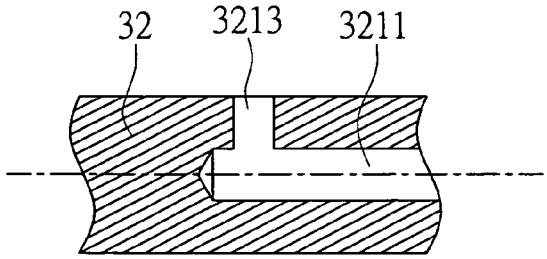

Please refer to FIGS. 4A and 4B, the oil supply channel 321 is allocated inside the crankshaft first section 32, in the present embodiment, the oil supply channel 321 comprises a first axial aperture 3211, which is connecting to interior of the crank case 3, and a first radial aperture 3213, which connects the first axial aperture 3211 and the pipeline 42; in addition, the oil supply channel 321 further comprises a first eccentric aperture 3215, which connects the first axial aperture 3211 and the interior of the crank case 3, and a first airtight oil plug 3217 is allocated at axle center of the crankshaft first section 32 corresponding to a rim of the first eccentric aperture 3215.

Figure 4C:
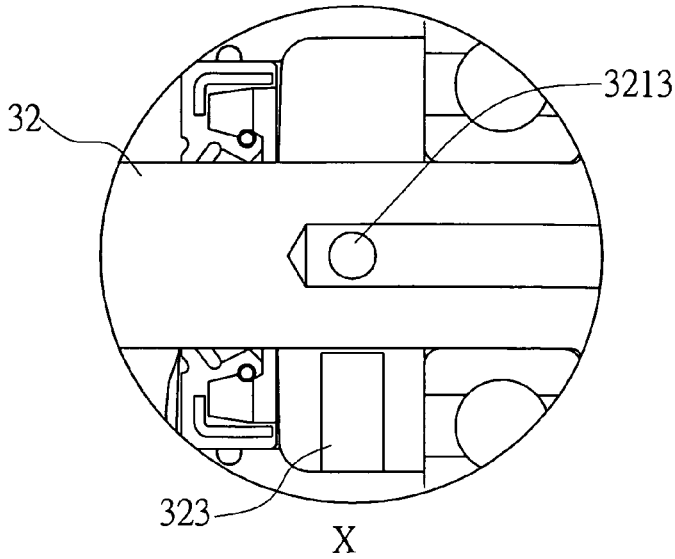
FIGS. 4C and 4D are a magnified diagram of block X and a lateral view of a first obstruction block of the block X of FIG. 3A, respectively.
Figure 4D:
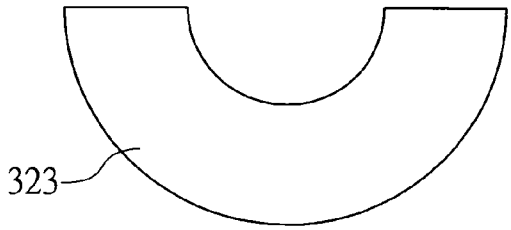

In addition, please refer to FIGS. 4C and 4D, a first obstruction block 323 is allocated on external side of the crankshaft first section 32 corresponding to the first radial aperture 3213, the first obstruction block 323 is in the form of a half circular ring and is for covering area of the first radial aperture 3213 of the crankshaft first section 32 beyond the first rotation angle; one end of the foresaid pipeline 42 is connecting to one side of the crank case 3 corresponding to the first radial aperture 3213, namely, space of opposite side of the first obstruction block 323, thereby connecting to the first radial aperture 3213 via the space.

According to the above disclosed design of oil supply path, when the crankshaft first section 32 is rotating, particles of oil drop are flung off via end side of the crankshaft first section 32 by centrifugal force, only oil mists are capable of passing through the oil supply channel 321, in other words, the first airtight oil plug 3217 mostly encloses exterior of the axle center of the first axial aperture 3211, therefore, the particles of oil drops can be flung off via end side of the crankshaft first section 32 by centrifugal force while rotating, and pressure difference enables the oil mists to travel only from the first eccentric aperture 3215 to the first axial aperture 3211.

The foresaid first radial aperture 3213 and the first obstruction block 323 compose a supply switch that controls oil supply; in the present invention, when the crankshaft first section 32 rotates to the first rotation angle, in other words, the first radial aperture 3213 is away from territory of the first obstruction block 323, and then in accordance with descending route of the piston 22, a positive pressure generated herein enables the oil mists to travel via the pipeline 42 passing the rocker arm room 4 to the cam room 5, thereby reaching objective of oil mists transmission.

Figure 5A:
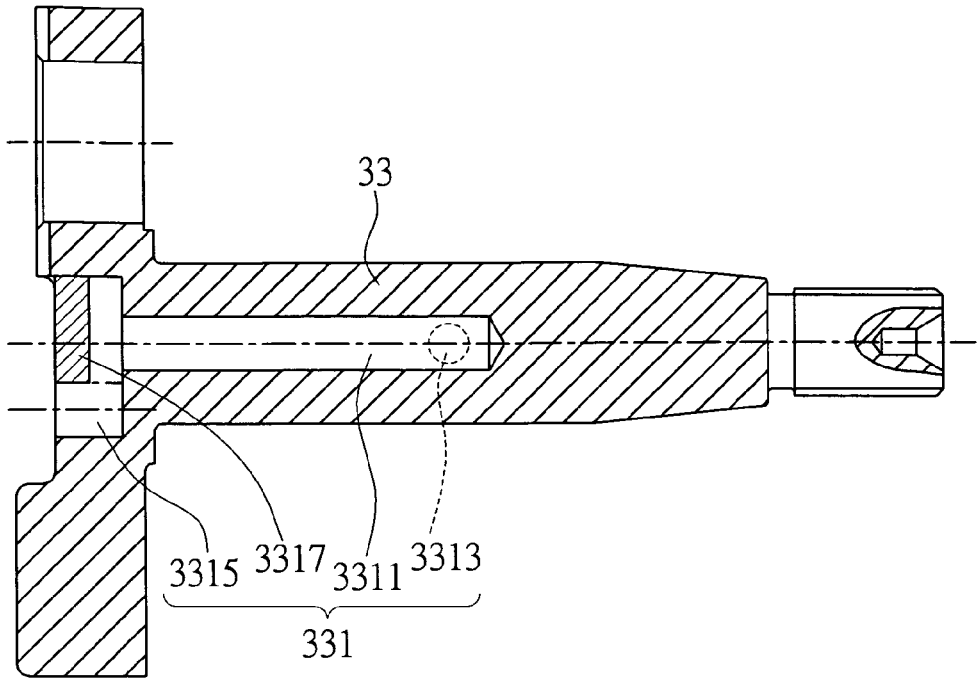
Figure 5B:
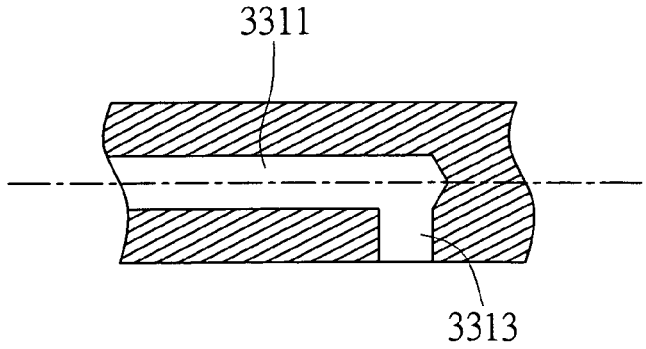
Figure 5C:
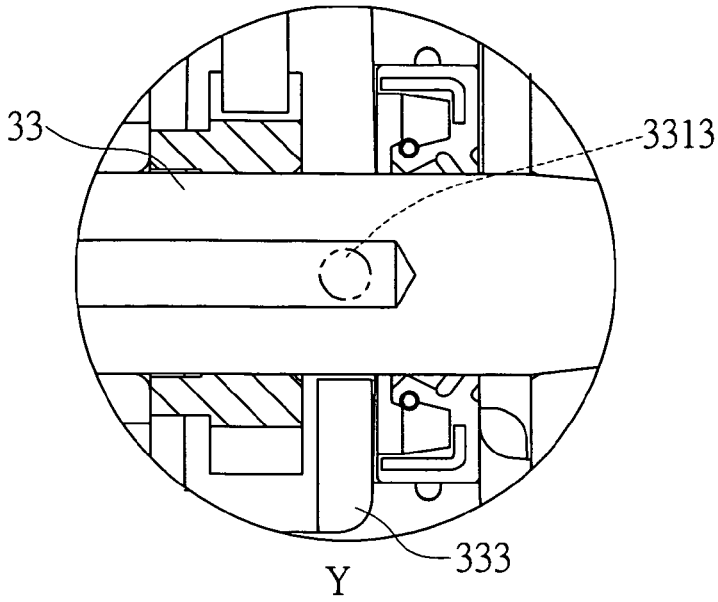
FIGS. 5C and 5D are a magnified diagram of block Y and a lateral view of a second obstruction block of the block Y of FIG. 3A, respectively.
Figure 5D:
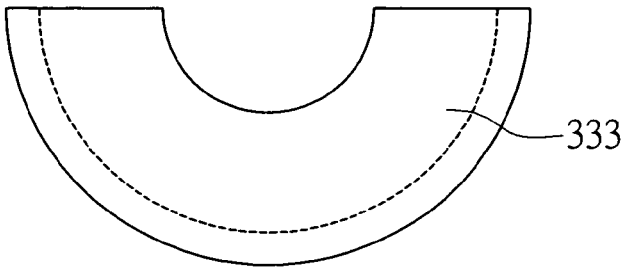

Please refer to FIGS. 5A and 5B, the oil recycling channel 331 is allocated on crankshaft second section 33; in the present invention, the oil recycling channel 331 comprises a second axial aperture 3311, which is connecting to the interior of the crank case 3, and a second radial aperture 3313, which connect the second axial aperture 3311 and the cam room 5. In addition, the oil recycling channel 331 further comprises a second eccentric aperture 3315, which are connecting the second axial aperture 3311 and the interior of the crank case 3, and a second airtight oil plug 3317, which is allocated at the axle center of the crankshaft second section 33 corresponding to a rim of the second eccentric aperture 3315, since the second airtight oil plug 3317 mostly encloses exterior of the axle center of the second axial aperture 3311, the particles of oil drops can be flung off via end side of the crankshaft second section 33 by centrifugal force while rotating, accordingly, pressure difference prevents the lubricant from traveling to the second axial aperture 3311 via the second eccentric aperture 3315. In addition, please refer to FIGS. 5C and 5D, the crankshaft second section 33 is allocated with a second obstruction block 333 corresponding to the second radial aperture 3313, the second obstruction block 333 is, for instance, in the form of a half circular ring and is for covering area of the second radial aperture 3313 of the crankshaft second section 33 beyond the second rotation angle.

According to the above disclosed design of oil recycling path, the second radial aperture 3313 and the second obstruction block 333 compose a re-absorption switch that controls oil mists or oil drops; in the present embodiment, when the crankshaft second section 33 rotates to the second rotation angle, in other words, the second radial aperture 3313 is away from territory of the second obstruction block 333, oil mists or oil drops can travel to the interior of the crank case 3 via the second radial aperture 3313 and the second axial aperture 3311, and in accordance with ascending route of the piston 22, a negative pressure generated inside the crank case 3 enables the oil mists to be re-absorbed and recycled. In addition, the second eccentric aperture 3315 is designed to employ centrifugal force for preventing oil drops inside the stirring chamber 34 from reflowing into the second axial aperture 3311. It must be specifically stated herein, the first rotation angle and the second rotation angle of the present embodiment are alternating to each other at an angle of 180 degrees as an example; in other words, when the crankshaft first section 32 rotates to the first rotation angle, the crankshaft second section 33 is at an angle 180 difference from the first rotation angle; therefore, the oil supply channel 321 and the oil recycling channel 331 open alternately, but not at the same time.

Moreover, although the crankshaft of the crank case 3 of the present embodiment consists of a crankshaft first section 32 and a crankshaft second section 33 that are connecting to each other via a connecting part 33 and moving simultaneously thus, it is not restrictive of the scope of the present invention; the said crankshaft can also be replaced with a single crankshaft, naturally, the single crankshaft can be divided into a first section, connection part, and a second section, and then form the foresaid oil supply channel 321 and oil recycling channel 331 on the first section and the second section respectively to achieve the same technique effect; since allocation of a single piece crankshaft or two pieces fabricated crankshaft that move simultaneously inside crank case of engine is commonly adopted technique by the industry, but not creative feature of the present invention, it has no need of detailed descriptions with illustrations herein.

Figure 6A:
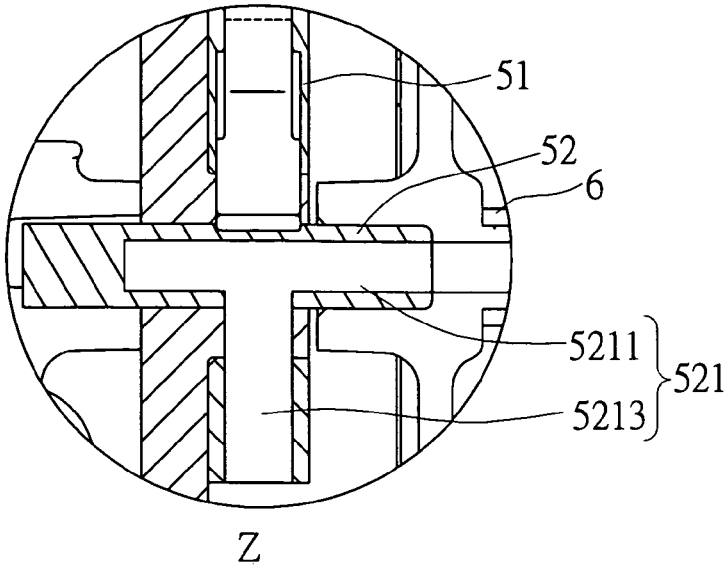
FIGS. 6A and 6B are a magnified diagram of block Z and a lateral view of cam and camshaft of the block Z of FIG. 3A, respectively.
Figure 6B:
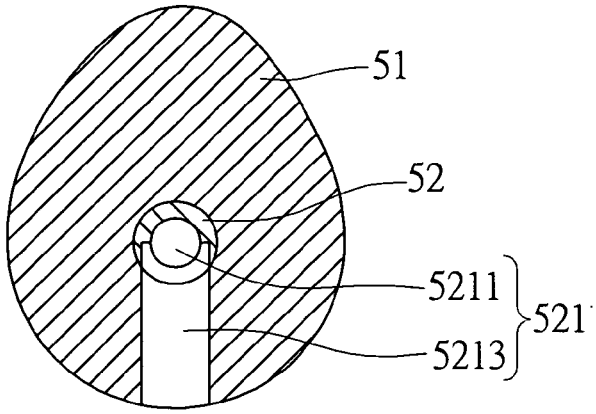

The cam room 5 has a cam 51 allocated therein, the cam 51 and a cam gear 53 are fixed on a camshaft 52, and the cam gear 53 is activated by a crankshaft gear 335 that is fixed on the crankshaft second section 33. Besides, the camshaft 52 is allocated with an exhaust channel 521 in order to connect the cam room 5 and the respiratory pipe 6, and the respiratory pipe 6 is for connecting to air filter, not shown in the FIG. Please refer to FIGS. 6A and 6B, in the present embodiment, the exhaust channel 521 comprises a third axial aperture 5211, which is allocated on the camshaft 52 and is connecting to the respiratory pipe 6, and a third radial aperture 5213, which connects the third axial aperture 5211 and the cam room 5. Since the rotation of the cam 51 and the camshaft 52 enables the third radial aperture 5213 to create fling centrifugal force, neither particles of oil drops nor massive oil mists will travel through the exhaust channel into the air filter while engine is operating.

When the engine is operating in a level state, as shown in FIGS. 3A, 4A through 4D, and 5A through 5D, the lubricant 71 capable of entering into the crank case 3 through oil holes 342 located on bottom of the long and narrow concave 341 underneath the crank case 3, and when the crankshaft, including the crankshaft first section 32 and crankshaft second section 33, is rotating, it simultaneously activates the oil stirring rod 23 at bottom end of the piston connecting rod 21 to stir lubricant inside the long and narrow concave 341 to form oil drops and oil mists, the oil drops and oil mists can be dispensed evenly inside space of the crank case 3, and the oil holes on two sides of the long and narrow concave 341 is capable of balancing interior pressures of the crank case 3 and lubricant tank 7.

When the crankshaft, including the crankshaft first section 32 and crankshaft second section 33 rotates counterclockwise to the first rotation angle, it enables the piston connecting rod 21 to descend, and consequently the interior pressure of the crank case 3 begins to increase due to reduced volume, thereby forcing oil mists inside the crank case 3 to travel into the oil supply channel 321 inside the crankshaft first section 32, and then through the first eccentric aperture 3215 and the first axial aperture 3211 to the first radial aperture 3213, at this moment, the relation between the first radial aperture 3213 and the first obstruction block 323 is in an opening state, the first obstruction block 323 is opposite to an opening space in communication with the pipeline 42, therefore the oil mists are capable of traveling into the pipeline 42, and then the oil mists can travel to the rocker arm room 4 through the pipeline 42 to lubricate the rocker arm 41 and other components, as well as travel to the cam room 5 to lubricate the cam 51, cam gear 53, and crankshaft gear 335; the design of the third radial aperture 5213 of the exhaust channel 521 employs centrifugal force to prevent massive oil mists from entering the air filter, and congealed liquid lubricant and oil mists are gathered underneath the cam room 5; at this moment, relation between the second radial aperture 3313 of the crankshaft second section 33 and the second obstruction block 333 is in a closing state.

When the piston 22 of the cylinder 2 descends to a dead end, the piston 22 is back on an ascending route, and then the first radial aperture 3213 of the crankshaft first section 32 and the first obstruction block 323 is in a closing state, while the second radial aperture 3313 of the crankshaft second section 33 and the second obstruction block 333 is in an opening state, and then the interior pressure of the crank case 3 begins to decrease due to expanded volume, therefore, via the second radial aperture 3313 of the crankshaft second section 33 and then passing through the second axial aperture 3311 and the second eccentric aperture 3315, the gathered lubricant and oil mists underneath the cam room 5 are absorbed into the crank case 3, and a lubrication cycle is completed thus.

Figure 7:
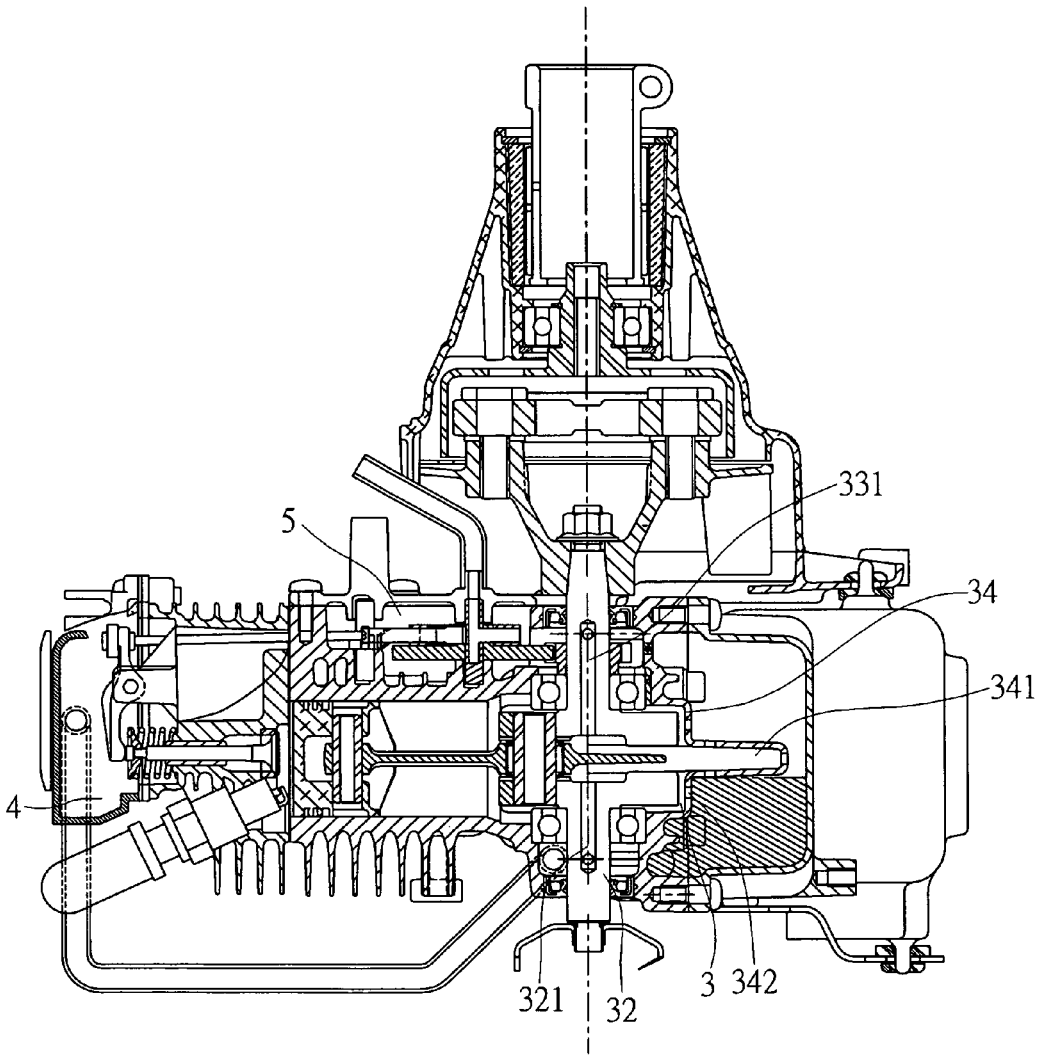
FIG. 7 illustrates an operation state of the lubrication device of four-stroke engines of the present invention, wherein the engine is turning at 90 degrees.

As shown in FIG. 7, when the engine is manipulated at a 90 degree angle, lubricant dispersion is affected by gravity, lubrication can be done by utilizing lubricant originally stored inside the long and narrow concave 341 of the crank case 3, and oil drops can be continuously provided to the crankshaft first section 32 via oil holes 342 on bottom of the stirring chamber 34 nearby two sides of the long and narrow concave 341, and then the oil drops are cracked into oil mists by rotating the crankshaft first section 32 for lubrication purpose; and in order to prevent excess lubricant from entering the rocker arm room 4, cam room 5, and air filter and consequent excessive lubrication or dead engine; the design of the oil supply channel 321, which employs centrifugal force as well as auto control over opening/closing, provides the lubrication device of the present invention with capability that allows oil mists to pass through but secludes the oil drops of larger particles from passing through, thereby effectively avoiding excessive lubrication; and the design of the oil recycling channel 331 provides the lubrication device of the present invention with capability that separates lubricant received in the crank case 3 from re-absorbed lubricant received in the cam room 5.

Figure 8:
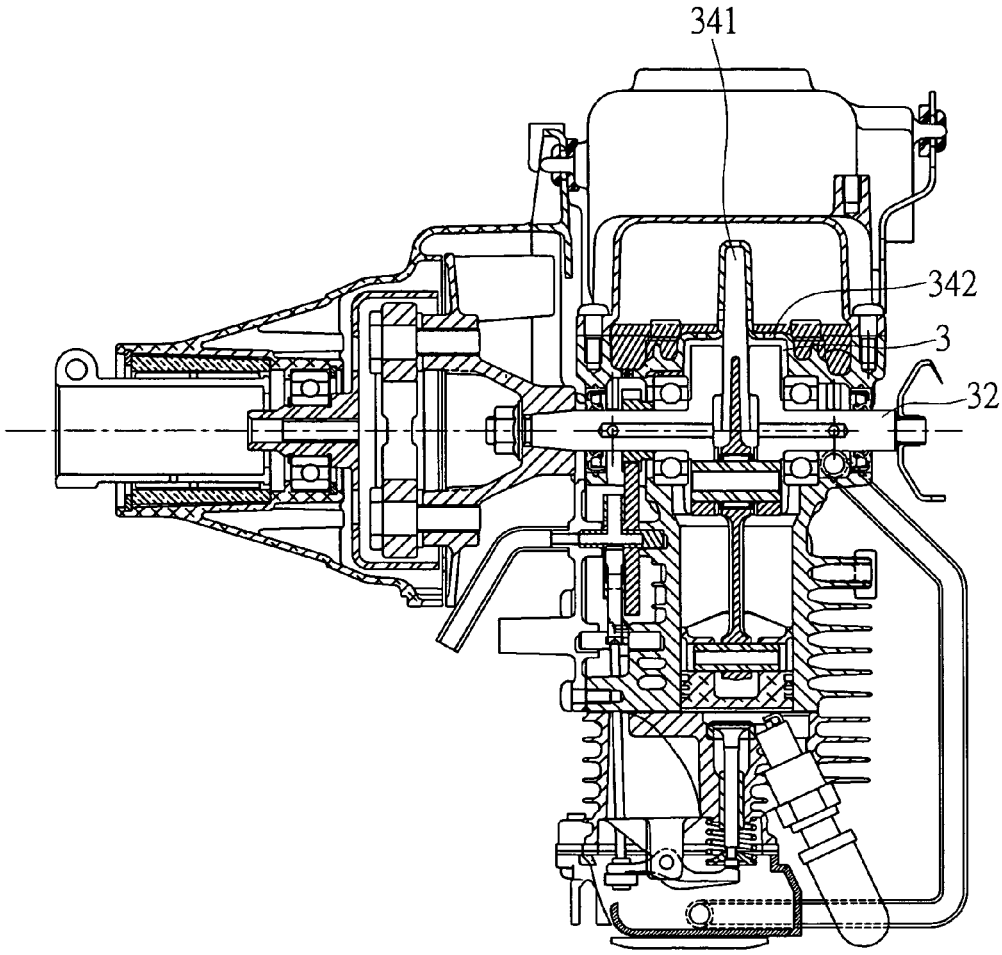
FIG. 8 illustrates an operation state of the lubrication device of four-stroke engines of the present invention, wherein the engine is turning at 180 degrees.

As shown in FIG. 8, when the engine is manipulated at 180 degree angle, the lubrication principle and path are the same as in the foresaid engine turning at 90 degree; in both situation, lubrication can be done by utilizing lubricant originally stored inside the long and narrow concave 341 of the crank case 3, and oil drops can be continuously provided to the crankshaft first section 32 via oil holes 342 on bottom of the stirring chamber 34 nearby two sides of the long and narrow concave 341, therefore, there is no need of repetitive detailed descriptions herein. According to the above disclosed descriptions, the lubrication device of the present invention is capable of providing proper lubrication and allowing engines to be manipulated normally at various angles.

The design of the exhaust channel 521 is capable of avoiding problems, such as massive lubricant flowing out from the respiratory pipe, and consequent massive lubricant consumption and air filter contamination; and in order to make the descriptions of the present invention simple and easier to be understood, the design of the exhaust channel 521 is included in the present embodiment, it is not an essential design of the present invention, it all depends on demand of practical application to selectively add in the exhaust channel 521.

Figure 9:
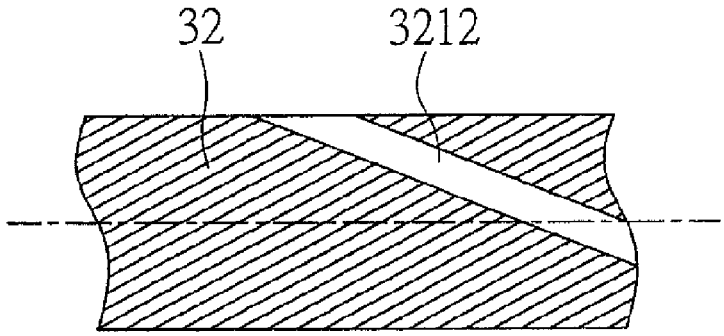
FIG. 9 is a lateral view of oil supply channel of another embodiment of the lubrication device of four-stroke engines of the present invention.
Figure 10:
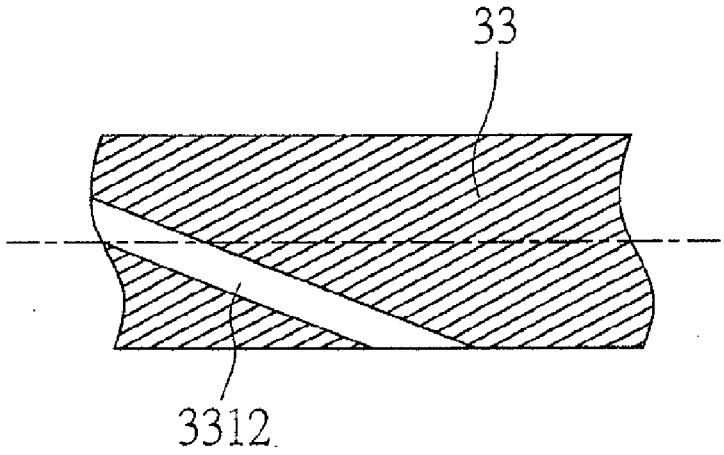
FIG. 10 is a lateral view of oil recycling channel of another embodiment of the lubrication device of four-stroke engines of the present invention.

In addition, although in the present embodiment, the oil supply channel 321 mainly comprises a first axial aperture 3211 allocated on a crankshaft first section 32 and a first radial aperture 3213, and the oil recycling channel 331 mainly comprises a second axial aperture 3311 allocated on a crankshaft second section 33 and a second radial aperture 3313, but this example is not restrictive of the scope of the present invention. For instance, as shown in FIG. 9, the first axial aperture 3211 and the first radial aperture 3213 of the crankshaft first section 32 can be replaced by a first slanting aperture 3212 that has a first end and a second end, plainly, the first end is connecting to the pipeline, and the second end is connecting to interior of the crank case, and designs of the first eccentric aperture and the first obstruction block are the same as in the previous embodiment, there is no need of repetitive descriptions herein. Similarly, as shown in FIG. 10, the second axial aperture 3311 and the second radial aperture 3313 of the crankshaft second section 33 can be replaced by a second slanting aperture 3312 that has a first end and a second end, plainly, the first end is connecting to cam room, and the second end is connecting to interior of crank case, and designs of the second eccentric aperture and the second obstruction block are also the same as in the previous embodiment, there is no need of repetitive description herein.

In view of the above, the lubrication device of four-stroke engines of the present invention mainly has the rocker arm room and the crank case connecting to each other, and the design of alternating oil supply and oil-absorption channels enables lubricant mists to cycle from the crank case through the rocker arm room to cam room and then to be re-absorbed into the crank case, thereby allowing engine to be manipulated at various angles; also the design of the oil supply path and the oil recycling path provides proper lubrication, and in accordance with the design of eccentric apertures and airtight oil plugs, situation of excess lubricant flowing out of the crank case can be avoided; in addition, the design of the exhaust channel employs centrifugal force to prevent oil drops or massive oil mists from entering, thereby avoiding problems of excessive lubricant consumption and air filter contamination caused by massive lubricant flowing out through the respiratory pipe. Therefore, the lubrication device of four-stroke engines provided by the present invention overcomes various drawbacks of the prior art, and conform to patent application elements: industrial applicability, novelty, and non-obviousness.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A lubrication device of four-stroke engines, which is applicable to a four-stroke engine that has a cylinder, a crank case, a rocker arm room and a cam room connected to the rocker arm room, the crank case having a crankshaft that is divided into a crankshaft first section, a connection part and a crankshaft second section, the cylinder having a piston connecting rod connected to the connection part, the lubrication device comprising:

a lubricant tank connected to a bottom of the crank case for containing lubricant;

a stirring chamber allocated beneath the crank case and partially located inside the lubricant tank, the stirring chamber having at least one oil hole in communication with the lubricant tank;

an oil stirring rod allocated at one end of the piston connecting rod and received in the stirring chamber for stirring lubricant to oil mists;

an oil supply path having a pipeline connected to the rocker arm room and the crank case, and an oil supply channel allocated inside the crankshaft first section and correspondingly connected to the pipeline and interior of the crank case, the oil supply channel being open when the crankshaft first section rotates to a first rotation angle, so as to supply the oil mists through the rocker arm room to the cam room; and an oil recycling path including an oil recycling channel allocated inside the crankshaft second section and correspondingly connected to the interiors of the cam room and the crank case, the oil recycling channel being open when the crankshaft second section rotates to a second rotation angle different from the first rotation angle, so as to re-absorb the oil mists into the crank case.

2. The lubrication device of four-stroke engines of claim 1, wherein the stirring chamber has a long and narrow concave disposed in the lubricant tank.

3. The lubrication device of four-stroke engines of claim 2, wherein each of the oil holes is allocated on at least on two sides and a bottom end of the long and narrow concave.

4. The lubrication device of four-stroke engines of claim 3, wherein each of the oil holes is further allocated on a bottom end of the stirring chamber nearby the two sides of the long and narrow concave.

5. The lubrication device of four-stroke engine of claim 1, wherein the first rotation angle and the second rotation angle are alternating to each other.

6. The lubrication device of four-stroke engines of claim 5, wherein the first rotation angle and the second rotation angle are alternating to each other at 180 degrees.

7. The lubrication device of four-stroke engines of claim 1, wherein the oil supply channel comprises a first axial aperture connected to interior of the crank case, and a first radial aperture connected to the first axial aperture and the pipeline.

8. The lubrication device of four-stroke engines of claim 7, wherein the oil supply channel further comprises a first eccentric aperture connected to the first axial aperture and interior of the crank case, and a first airtight oil plug allocated at an axle center of the crankshaft first section corresponding to a rim of the first eccentric aperture.

9. The lubrication device of four-stroke engines of claim 8 further comprising a first obstruction block allocated on an external side of the crankshaft first section corresponding to the first radial aperture, for covering an area beyond the first rotation angle.

10. The lubrication device of four-stroke engines of claim 9, wherein the first obstruction block is in the form of a half circular ring.

11. The lubrication device of four-stroke engines of claim 1, wherein the oil recycling channel comprises a second axial aperture connected to the interior of the crank case, and a second radial aperture connected to the second axial aperture and the cam room.

12. The lubrication device of four-stroke engines of claim 11, wherein the oil recycling channel further comprises a second eccentric aperture connected to the second axial aperture and the interior of the crank case, and a second airtight oil plug allocated at axle center of the crankshaft second section corresponding to a rim of the second eccentric aperture.

13. The lubrication device of four-stroke engines of claim 12 further comprising a second obstruction block allocated on an external side of the crankshaft second section corresponding to the second radial aperture, for covering an area beyond the second rotation angle.

14. The lubrication device of four-stroke engines of claim 13, wherein the second obstruction block is in the form of a half circular ring.

15. The lubrication device of four-stroke engines of claim 1, wherein the oil supply channel comprises a first slanting aperture, the first slanting aperture having a first end connected to the pipeline, and a second end connected to interior of the crank case.

16. The lubrication device of four-stroke engines of claim 15, wherein the oil supply channel further comprises a first eccentric aperture connected to the second end and the interior of the crank case, and a first airtight oil plug allocated at an axle center of the crankshaft first section corresponding to a rim of the first eccentric aperture.

17. The lubrication device of four-stroke engines of claim 16 further comprising a first obstruction block allocated on an external side of the crankshaft first section corresponding to the first end, for covering an area beyond the first rotation angle.

18. The lubrication device of four-stroke engines of claim 1, wherein the oil recycling channel comprises a second slanting aperture, the second slanting aperture having a first end connected to the cam room, and a second end connected to interior of the crank case.

19. The lubrication device of four-stroke engines of claim 18, wherein the oil recycling channel further comprises a second eccentric aperture connected to the second end and the interior of the crank case, and a second airtight oil plug allocated at an axle center of the crankshaft second section corresponding to a rim of the second eccentric aperture.

20. The lubrication device of four-stroke engines of claim 19 further comprising a second obstruction block allocated on an external side of the crankshaft second section corresponding to the first end, for covering an area beyond the second rotation angle.

21. A lubrication device of four-stroke engines, which is applicable to a four-stroke engine that has a cylinder, a crank case, a rocker arm room, a cam room connected to the rocker arm room, and a respiratory pipe, the crank case having a crankshaft first section and a crankshaft second section connected via a connection part to the crankshaft first section and moving simultaneously with the crankshaft first section, the cylinder having a piston connecting rod connected to the connection part, the cam room being provided with a cam having a camshaft, the lubrication device comprising:

a lubricant tank connected to a bottom of the crank case for containing lubricant;

a stirring chamber allocated underneath the crank case and partially located inside the lubricant tank, the stirring chamber having at least one oil hole in communication with the lubricant tank;

an oil stirring rod allocated at one end of the piston connecting rod and is received in the stirring chamber for stirring lubricant to oil mists;

an oil supply path having a pipeline connected to the rocker arm room and the crank case, and an oil supply channel allocated inside the crankshaft first section and correspondingly connected to the pipeline and interior of the crank case, the oil supply channel being open when the crankshaft first section rotates to a first rotation angle, so as to supply oil mists through the rocker arm room to the cam room;

an oil recycling path having an oil recycling channel allocated inside the crankshaft second section and correspondingly connected to interiors of the cam room and the crank case, the oil recycling channel being open when the crankshaft second section rotates to a second rotation angle different from the first rotation angle, so as to re-absorb the oil mists to the interior of the crank case; and an exhaust channel having a third axial aperture allocated on the camshaft and connected to the respiratory pipe, and a third radial aperture connected to the third axial aperture and the cam room.

22. The lubrication device of four-stroke engines of claim 21, wherein the third radial aperture is vertical to the third axial aperture.

23. The lubrication device of four-stroke engines of claim 21, wherein the camshaft is connected to the respiratory pipe.

* * * * *